United States Patent [19]

Moulton

[11] Patent Number: 5,076,797

[45] Date of Patent: Dec. 31, 1991

[54] SELF-TERMINATING COAXIAL PLUG CONNECTOR FOR CABLE END INSTALLATION

[75] Inventor: James I. Moulton, Sunnyvale, Calif.

[73] Assignee: Apple Computer, Inc., Cupertino, Calif.

[21] Appl. No.: 596,129

[22] Filed: Oct. 11, 1990

[51] Int. Cl.[5] ..... H01R 29/00

[52] U.S. Cl. ..... 439/188; 200/51.1

[58] Field of Search ..... 439/188, 578, 579, 580, 439/581, 582, 583, 584, 585, 620, 675; 200/51.1, 51.09, 51 R

[56] References Cited

U.S. PATENT DOCUMENTS

| | | | |
|---|---|---|---|
| 3,784,950 | 1/1974 | Coffman | 200/51.1 X |
| 3,873,785 | 3/1975 | Lieberman | 200/51.1 |
| 4,099,825 | 7/1978 | Jackson | 200/51.1 X |
| 4,575,694 | 3/1986 | Lapke et al. | 200/51.1 X |
| 4,804,339 | 2/1989 | Cohen | 439/588 |
| 4,971,569 | 11/1990 | Gooch et al. | 439/188 |

*Primary Examiner*—Neil Abrams
*Assistant Examiner*—Khiem Nguyen
*Attorney, Agent, or Firm*—Mark Aaker

[57] ABSTRACT

A self-terminating coaxial connector for installation on the end of a coaxial cable has a coaxial connector plug with a center conductor surrounded by a shield, and within the plug, a switch contact spring and a termination circuit element. The switch contact spring is mounted within the shield substantially parallel to and separated by a spaced gap from the center conductor. The switch contact spring has an end near the center conductor and open end of the plug folded back to cross the spaced gap and movably contact to the center conductor. This movable contact is moved out of contact to the center conductor by coupling of the plug to a mating socket connector. Also within the plug is a termination circuit element connecting from the switch contact spring through the termination circuit element to the shield. This self-terminating plug design has reduced signal reflection and signal radiation problems, and has a simplified mechanical assembly within the connector.

8 Claims, 1 Drawing Sheet

SELF-TERMINATING COAXIAL PLUG CONNECTOR FOR CABLE END INSTALLATION

BACKGROUND OF THE INVENTION

This invention relates to electrical connectors, particularly to a self-terminating coaxial plug connector for installation on the end of a coaxial cable.

Coaxial cables and connectors typically have a center conductor insulated from and surrounded by a shield. Coaxial cables and connectors are commonly used for high frequency electrical signals, since the coaxial design provides a more uniform electrical impedance, and the surrounding shield prevents electrical signals from radiating into or out of the inner conductor. Coaxial connectors are designed to maintain these characteristics of uniform impedance and shielding of the center conductor.

When a coaxial connector is left "open" or unconnected, the uniform impedance and shielding characteristics are disturbed, and undesirable reflection of signals and radiation of electrical signals into and out of the center connector can occur. A "self-terminating" connector reduces these problems by automatically switching to a "terminated" condition when the connector is left open or uncoupled. A terminated condition exists when the center conductor is connected to the shield through a termination circuit element having the same characteristic impedance as the coaxial connector and cable.

One type of self-terminating connector is shown in U.S. Pat. No. 4,575,694 to Lapke et al. Lapke et al shows a connector to be used on the end of a coaxial cable which switches to a terminated condition when the connector is uncoupled or disconnected from a compatible connector. Lapke et al discloses a sliding dielectric sleeve disposed in the connector shell for movement between a first position and a second position which moves a switch element to include or exclude a termination circuit element. The sliding dielectric sleeve is biased by a coil spring in the shell behind the sleeve, and movement of the sleeve is driven by abutment with the face of a compatible connector during the coupling of two compatible connectors. Unfortunately, the design of Lapke et al leaves a substantial portion of the center conductor extending beyond the point of connection to the termination element inside the connector. This extension can cause both the reflection and signal radition problems earlier described. Also, the design of Lapke et al requires a large number of moving mechanical elements to be assembled within the connector body, greatly increasing the cost and reducing the reliability of the connector.

A second type of self-terminating connector is shown in co-pending U.S. patent application Ser. No. 07/369,382, filed 06/21/89 and entitled SELF-TERMINATING COAXIAL TAP CONNECTOR (as amended) on which the present applicant is a co-inventor. In a first embodiment, this invention shows a self-terminating connector port which uses a sliding dielectric element to move a switch contact away from the center conductor. A second embodiment, without a sliding dielectric element, uses the mating connector to move a switch contact away from a contact land which runs through a termination circuit element to the center conductor. However, these designs also suffer from the presence of an extension of the center conductor beyond the point of termination which can cause the reflection and signal radiation problems earlier described. Also, the designs require a number of mechanical elements to be assembled within the connector body, greatly increasing the cost and reducing the reliability of the connector.

SUMMARY OF THE INVENTION

This invention provides a self-terminating coaxial plug connector for installation on the end of a coaxial cable. A connector in accordance with this invention is self-terminating, has reduced signal reflection and signal radiation problems, and has a simplified mechanical assembly within the connector for reduced cost and increased reliability.

In accordance with this invention, a self-terminating coaxial plug connector for installation on the end of a coaxial cable has a coaxial plug connector with a switch contact spring and a termination circuit element within the plug.

The coaxial plug connector has an open end for coupling to a mating coaxial socket connector, and a cable end for attachment to a coaxial cable. The plug has a center conductor surrounded by a shield.

Within the plug is a switch contact spring mounted within the shield substantially parallel to and separated by a spaced gap from the center conductor. The switch contact spring has first and second ends, the first end which is near the open end of the plug is folded back to extend across the spaced gap and contact to the center conductor. This movable contact is flexed out to the center conductor by coupling of the plug to a mating socket connector.

Also within the plug is a termination circuit element connecting from the second end of the switch contact spring through the termination circuit element to the shield.

DETAILED DESCRIPTION

Figure 1:
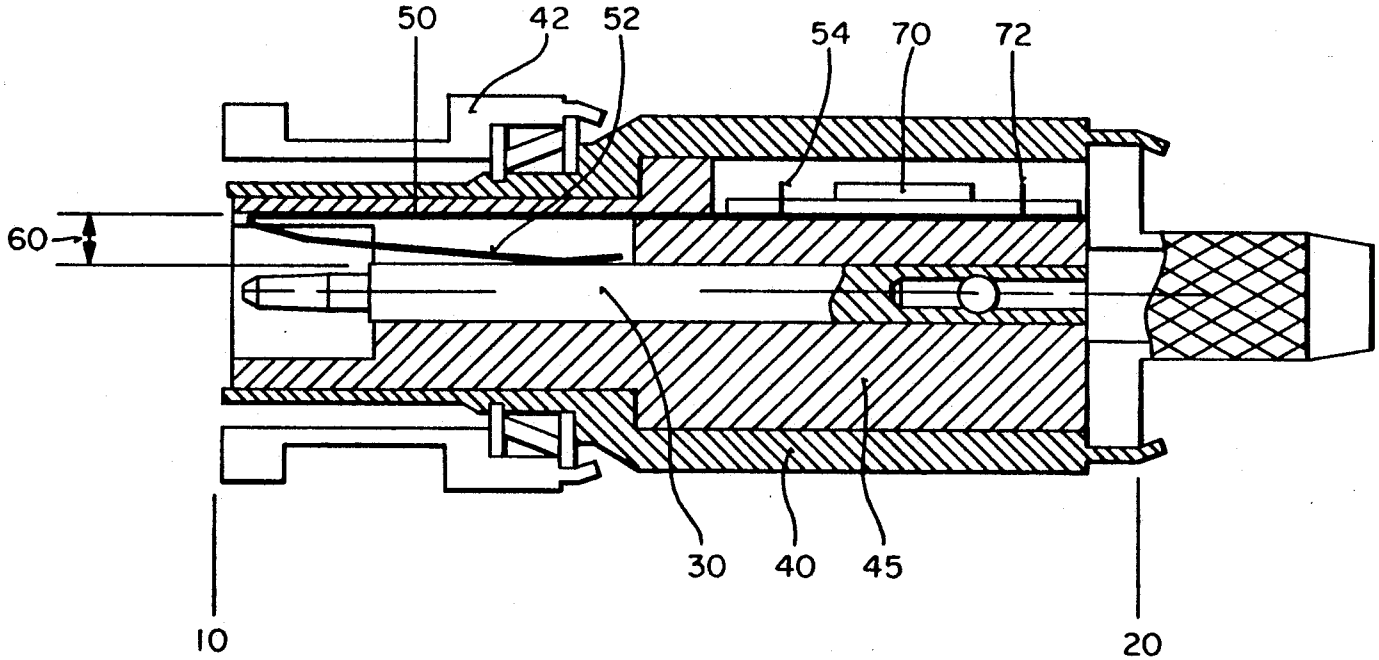
FIG. 1 is a cut-away side view of a self-terminating coaxial plug connector for installation on the end of a coaxial cable in accordance with this invention.

FIG. 1 is a cut-away side view of a self-terminating coaxial plug connector for installation on the end of a coaxial cable in accordance with this invention.

FIG. 1 shows a coaxial plug connector having an open end 10 for coupling to a mating socket connector, and a cable end 20 for attachment to a coaxial cable. The plug connector is attached to a coaxial cable by conventional, known methods. The coaxial connector plug has a center conductor 30 surrounded by a shield 40. In a preferred embodiment, the plug is of a BNC style and dimensions. In the BNC style, there is a slotted lock nut 42 rotatably mounted outside the shield 40 on the open end 10 for coupling and locking to a compatible BNC socket.

Within the plug is a switch contact spring 50 mounted within the shield 40 substantially parallel to and separated by a spaced gap 60 from the center conductor 30, the switch contact spring having a first end 52 and a second end 54, with the first end 52 which is near the open end 10 of the plug being folded back to reach across the spaced gap 60 and movably contact to the center conductor 30. The first end 52 is moved out of contact to the center conductor 30 by coupling of the plug to a mating socket connector, which introduces portion of the body of the mating socket connector into the spaced gap 60, thereby displacing the first end 52 and moving it out of contact to the center conductor 30. Spring contact 50 or at least its first end 52 is formed of flexible and resilient electrically conductive material such as spring steel, or coated or plated spring material. The switch contact spring can be an elongated, flat piece of spring steel with an end formed, bent or folded back.

Also within the plug is a termination circuit element 70 connecting from the second end 54 of the switch contact spring 50 through the termination circuit element 70 to the shield 40. The termination circuit element can be a resistor of standard axial lead tubular form, or in the embodiment shown in FIG. 1, the termination circuit element 70 is a 50 ohm chip resistor mounted to two contacts on a small rectangle of printed circuit board. A first contact is tacked and soldered to the second end 54 of the switch contact spring 50. The second contact is soldered to a clip 72 which contacts the inner wall of the shield 40 near the cable end 20 of the plug.

Because the folded back first end 52 of the switch contact spring 50 can contact closer to the open end 10 of the center conductor 30 than to the cable end 20, very little center conductor 30 extends beyond the contact point, and signal reflection and signal radiation problems are reduced. Because there are only two parts, the switch contact spring 50 and the termination circuit element 70, and only the switch contact spring 50 has any moving parts, the plug has a simplified mechanical assembly within the shield 40 for reduced cost and increased reliability.

Portions of the space between center conductor 30 and shield 40 are filled with an insulator 45, while other portions are left open for the receipt of other connector components such as termination circuit element 70, and for receiving the body of a mating socket connector as in the spaced gap 60. Where the mating socket connector has switch contact elements within it, it is important that interference between the plug and socket switch contacts be avoided to allow proper operation of each. This can be accomplished by limiting the rotation of the BNC style slotted lock nut 42 around the outside of the shield 40, for example allowing rotation from 0 to 90 degrees. A standard BNC plug can be coupled in two positions, 180 degrees from each other, so rotation would also be allowed in the range 180 to 270 degrees. The switch contact of the plug is then oriented within the plug to appear within these angular ranges. Conversely, the switch contact in the socket can be oriented to fit outside these ranges, for example in the ranges 90 to 180 degrees and 270 to 360 degrees. In this way interference between plug and socket switch contacts can be avoided.

In operation, during coupling of the plug to a mating socket connector, the spaced gap 60 is entered and occupied by portions of the body of the mating socket connector, forcing the first end 52 of spring contact 50 to move upward to a position out of contact with the center conductor 30. In this "squeeze" process, the folded back portion 52 will be compressed and narrowed, moving away and losing contact with the center conductor 30. Therefore, the center conductor will not longer be terminated through spring contact 50 and termination circuit element 70. Uncoupling of the plug and socket, and removal of the portions of the body of the mating socket from spaced gap 60 allows the first end 52 of switch contact spring 50 to return a position crossing the spaced gap 60 and contacting to the center conductor 30, reestablishing the termination of the center conductor 30.

These and other embodiments of the invention can be practiced without departing from the true scope and spirit of the invention, which is defined by the following claims.

I claim:

1. A self-terminating coaxial plug connector for installation on the end of a coaxial cable comprising:

a coaxial connector plug having an open end for coupling to a mating socket connector and a cable end for attachment to a coaxial cable, said plug having a center conductor surrounded by a shield;

a switch contact spring mounted within said shield substantially parallel to and separated by a spaced gap from said center conductor, said switch contact spring having first and second ends, said first end near said open end of said plug being folded back to cross said spaced gap and extend away from the open end and bias against said center conductor, said first end being moved out of bias against said center conductor by coupling of said plug to a said mating socket connector with direct engagement of the socket and the contact spring; and a termination circuit element within said shield connecting from said second end of said switch contact spring through said termination circuit element to said shield.

2. A self-terminating coaxial connector as in claim 1 wherein said coaxial connector plug and said mating socket connector are of a BNC style.

3. A self-terminating coaxial connector as in claim 1 wherein said switch contact spring is an elongated, flat piece of spring steel with an end folded back to form said first end.

4. A self-terminating coaxial connector as in claim 1 wherein said termination circuit element is resistor.

5. A self-terminating coaxial plug connector for installation on the end of a coaxial cable comprising:

a BNC style coaxial connector plug having an open end for coupling to a mating socket and a cable end for attachment to a coaxial cable, said plug having a center conductor surrounded by a shield, said shield having a rotating lock nut around said open end;

said center conductor running axially centered within said shield and adapted for connecting to a center conductor of said coaxial cable at said cable end, and said center conductor exposed at said open end for coupling to said mating socket;

a switch contact spring of resilient electrical conductive material within said shield running substantially parallel to said center conductor and separated from it by a spaced gap, said switch contact spring having a first end near said open end of said plug, and a second end near said cable end of said plug, said first end having a folded back contact portion, formed to cross said spaced gap and extend away from the open end and bias against said center conductor near said open end of said plug, said first end being moved out of bias against said center conductor by the coupling of a said mating socket to said plug with direct engagement of the socket and the contact spring; and a termination circuit element within said shield connecting from said second end of said switch contact spring to said shield.

6. A self-terminating coaxial plug connector as in claim 5 wherein said switch contact spring is an elongated, flat piece of spring steel, with an end folded back to form said first end.

7. A self-terminating coaxial plug connector as in claim 5 wherein said rotating lock nut is limited in rotation to less than 180 degrees.

8. A self-terminating coaxial plug connector as in claim 5 wherein said termination circuit element is a chip resistor mounted on a printed circuit board.

* * * * *